United States Patent [19]

Szostak

[11] 4,284,018

[45] Aug. 18, 1981

[54] CONVERSION ASSEMBLY FOR SEWING MACHINE SPEED CONTROLLER

[75] Inventor: Jan Szostak, Lincroft, N.J.

[73] Assignee: The Singer Company, Stamford, Conn.

[21] Appl. No.: 90,714

[22] Filed: Nov. 2, 1979

[51] Int. Cl.[3] ..... D05B 69/00

[52] U.S. Cl. ..... 112/217.4; 112/270

[58] Field of Search ..... 112/217.4, 217.3, 270, 112/277, 217.1

[56] References Cited

U.S. PATENT DOCUMENTS

| | | | |
|---|---|---|---|
| 2,055,432 | 9/1936 | Goosman et al. | 112/270 X |
| 2,065,428 | 12/1936 | Chason | 112/270 X |
| 3,570,428 | 3/1971 | Sternbery | 112/270 |

FOREIGN PATENT DOCUMENTS

| | | | |
|---|---|---|---|
| 53-102763 | 8/1978 | Japan | 112/270 |

*Primary Examiner*—H. Hampton Hunter

*Attorney, Agent, or Firm*—David L. Davis; Robert E. Smith; Edward L. Bell

[57] ABSTRACT

An assembly for converting a sewing machine speed controller of the foot operated type to hand operation thereof includes a housing for slidably accepting the speed controller therein. Hand operable speed setting means mounted on the housing are provided for an operator to manipulate so as to set a desired speed, the speed setting means maintaining its set condition. Actuator means are further provided, coupled to the speed setting means and responsive to a set condition thereof for controlling the compression of the speed controller.

7 Claims, 6 Drawing Figures

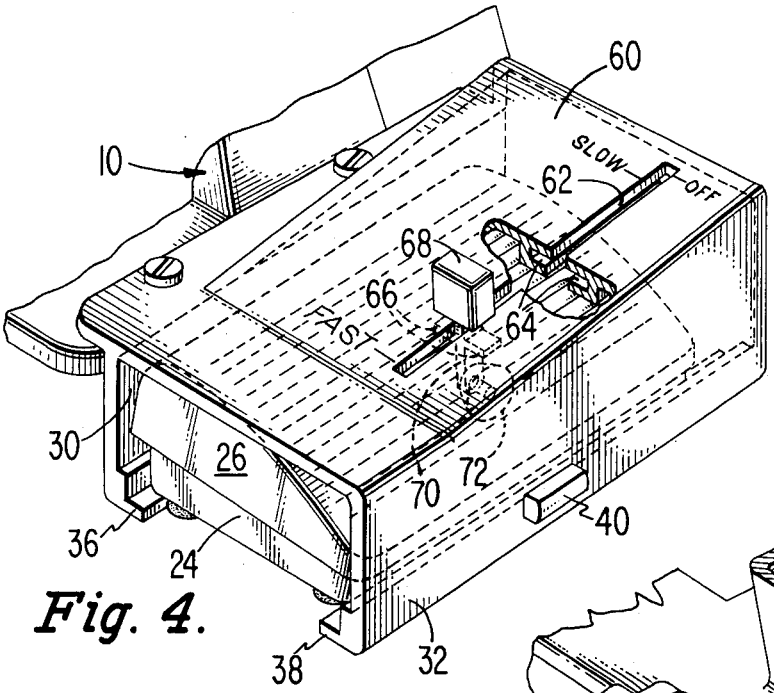
Fig. 4.
Fig. 3.
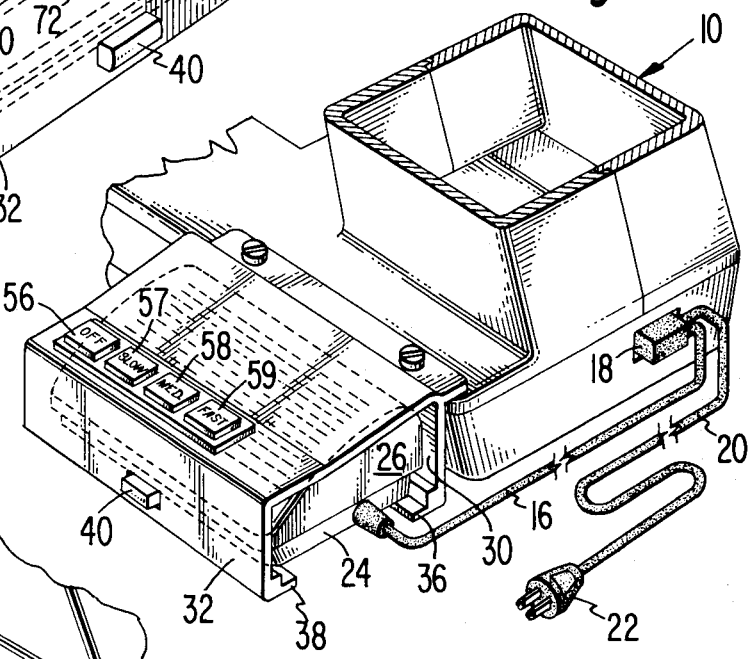
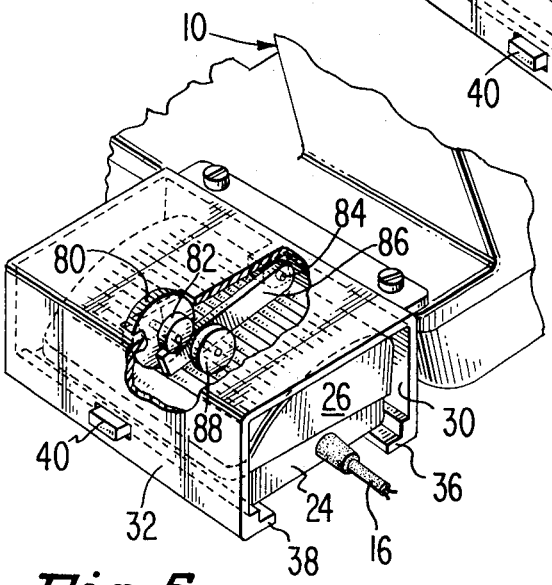
Fig. 5.
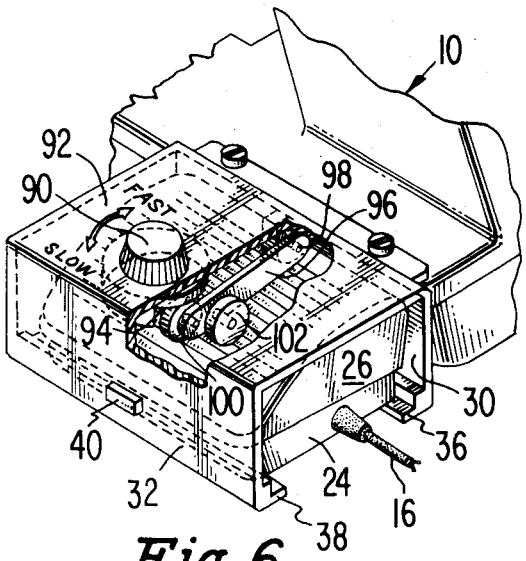
Fig. 6.

CONVERSION ASSEMBLY FOR SEWING MACHINE SPEED CONTROLLER

BACKGROUND OF THE INVENTION

This invention relates to sewing machine motor speed controllers and, more particularly, to an assembly for converting a speed controller of the foot operated type to hand operation thereof.

Electric motor driven sewing machines are typically provided with a speed controller to enable the operator of the sewing machine to control the speed thereof. Such a speed controller is conventionally connected to the sewing machine through an electrical cord that enables the speed controller to be placed on the floor for foot operation thereof. Alternatively, these controllers may be mounted under the sewing machine cabinet where they may be actuated by knee operation of the operator. In any event, the conventional speed controller requires the operator to apply a force thereon which is in direct proportion to the desired operating speed of the sewing machine. Further, such controllers require the operator to maintain that force at the desired level. There are many instances where it may not be practical to have a foot or knee operated speed controller. For example, in many parts of the world, sewing machines are placed on low tables and the operator sits on the floor in front of the sewing machine. Thus, there is a need for a sewing machine speed controller which may be hand operated. In the past, such hand operated speed controllers have been designed as distinctly separate entities considerably different from a foot controller. However, it would be desirable to enable a speed controller of the foot operated type to be convertible to hand operation thereof.

It is therefore an object of this invention to provide an assembly for converting a sewing machine speed controller of the foot operated type to hand operation thereof.

One way of accomplishing the foregoing objective would be to provide a holder adapted to receive therein a sewing machine speed controller of the foot operated type and provide some mechanism, for example a lever, which would enable the operator to exert a speed controlling force on the controller. However, this approach is undesirable because the operator needs maximum hand freedom to guide the work piece being sewn. It is therefore another object of this invention to provide such an assembly which allows for maximum operator hand freedom.

SUMMARY OF THE INVENTION

The foregoing and additional objects are attained in accordance with the principles of this invention by providing an assembly for converting a sewing machine speed controller of the foot operated type to hand operation thereof, wherein the controller is of the type that the amount of compression of the controller determines the speed of the sewing machine. The assembly comprises a housing for slidably accepting the speed controller therein. The housing is adapted to be mounted on the sewing machine and includes a front wall, a rear wall, a top wall and a lower support for the controller. There is further provided hand operable speed setting means mounted on the top wall of the housing and accessible to an operator for allowing the operator to manipulate the setting means to a specific condition so as to set a desired speed for the sewing machine, the setting means maintaining the set condition. Additionally, there is provided actuator means coupled to the speed setting means and responsive to a set condition thereof for controlling the compression of the controller.

BRIEF DESCRIPTION OF THE DRAWINGS

The foregoing will be more readily apparent upon reading the following description in conjunction with the drawings wherein:

FIG. 3 is a perspective view of a second embodiment of an assembly constructed in accordance with the principles of this invention and showing an alternate mounting arrangement;

FIG. 4 is a perspective view of a third embodiment of an assembly constructed in accordance with the principles of this invention;

FIG. 5 is a perspective view, partially broken away, of a fourth embodiment of an assembly constructed in accordance with the principles of this invention; and FIG. 6 is a perspective view, partially broken away, of a fifth embodiment of an assembly constructed in accordance with the principles of this invention.

DETAILED DESCRIPTION

Figure 1:
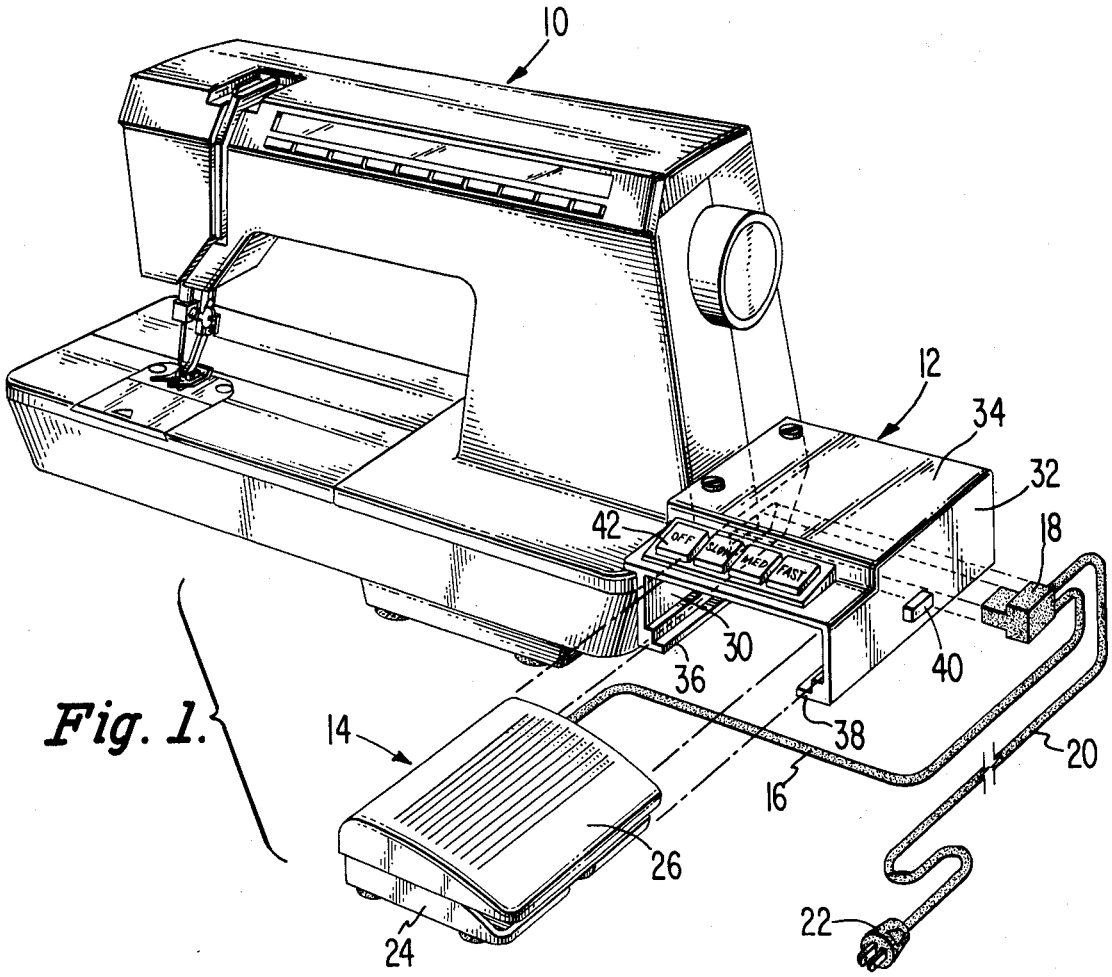
FIG. 1 is a perspective view of a sewing machine having mounted thereon a first embodiment of an assembly according to the present invention and further showing a foot operated speed controller and the manner of its reception into the assembly.

Referring now to the drawings, wherein like elements in different figures thereof have the same reference character applied thereto, shown in FIG. 1 is a sewing machine designated generally by the reference numeral 10 having mounted on the side thereof an assembly 12 constructed in accordance with the principles of this invention. To control the speed of the sewing machine 10, there is provided a speed controller 14 connected to the sewing machine 10 through an electrical cord 16. The cord 16 is terminated by a plug 18 which is adapted to be inserted into a suitable receptacle on the base of the sewing machine 10. The plug 18 also has extending therefrom an electrical line cord 20 terminated by a plug 22 which is adapted to be connected to a source of commercially available power. The speed controller 14 is illustratively of the type disclosed in U.S. Pat. No. 3,353,424, entitled "Motor Speed Controllers", which issued on Nov. 21, 1967, to W. R. Peterson et al, and to which reference may be had for a more complete understanding thereof. In any event, the speed controller 14 includes a base 24 and a cover 26 which are hinged along one side so that a generally vertical force applied to the cover 26 will cause the cover 26 to be telescoped with respect to the base 24. Within the speed controller 14 there is provided a spring-like member which opposes this telescoping. The amount of telescoping of the parts 24 and 26 determines the speed of the sewing machine 10. Although the speed controller 14 described above has a telescoping action, the assembly according to the present invention is intended to work with a speed controller of the general type wherein the spacing between an upper member and a lower member is varied in accordance with a force exerted thereon to control the speed of the sewing machine to which the controller is attached. This action of changing the spacing will be referred to hereinafter as "compression" of the speed controller.

Figure 2:
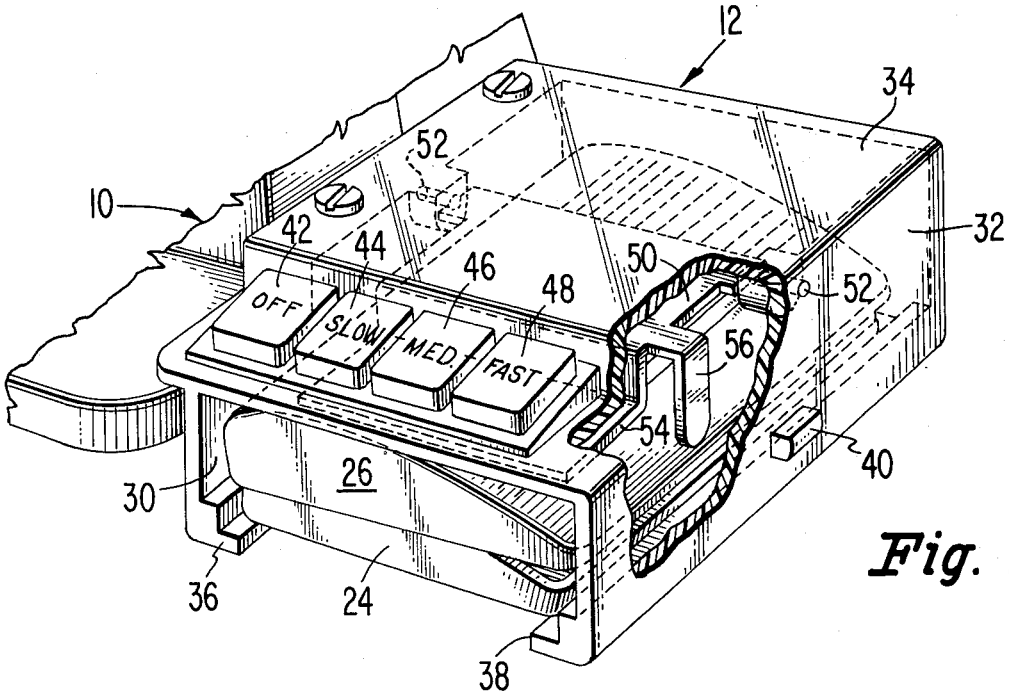
FIG. 2 is an enlarged perspective view, partially broken away, of the assembly shown in FIG. 1.

As shown in FIGS. 1 and 2, the assembly 12 according to the present invention generally comprises a housing with a rear wall 30 positioned against the sewing machine 10, a front wall 32 and a top wall 34. The housing is also provided with a lower support for the controller 14. This lower support includes flange-like extensions 36 and 38 of the rear wall 30 and the front wall 32, respectively. The controller 14 is then slidably moved within the assembly housing when it is desired to utilize the controller 14 in a hand operated mode. Also provided on the front wall 32 of the assembly housing is a latching mechanism including a latch button 40 for releasably securing the controller 14 in the housing 12. The latching mechanism may be of conventional design and be spring loaded, depression of the button 40 causing a release of the controller 14.

In order to set a desired speed for the sewing machine, according to a first embodiment of the assembly 12 there is provided a plurality of push buttons 42, 44, 46 and 48 mounted on the top wall 34 of the housing 12. These push buttons are of the radio interlock type wherein only one button at a time can be depressed. Each of the buttons 44, 46 and 48 extends into the housing 12 a different distance when depressed. In particular, the button 44 extends the least and the button 48 extends the most so that the button 44 corresponds to a slow speed, the button 48 corresponds to a fast speed and the button 46 corresponds to a middle speed. The button 42 is utilized to release the buttons 44, 46 and 48 when it is desired to stop the sewing machine. To compress the controller 14 in response to depression of one of the buttons 44, 46, 48, there is provided an actuator means which includes a plate 50 hinged at 52. The plate 50 has an extension 54 underlying the push buttons 44, 46, 48, and a force transmitting finger 56. When one of the push buttons 44, 46, 48 is depressed, it contacts the extension 54 of the plate 50 and depending upon the distance the depressed push button extends into the housing 12, the plate 50 is pivoted about 52 by a predetermined amount. This causes the finger 56 to contact the cover 26 of the controller 14 and compress it an amount corresponding to the desired speed set by depression of one of the buttons 44, 46, 48.

FIG. 3 depicts a second embodiment of the assembly which is mounted on the front of the sewing machine 10 and wherein the plurality of push buttons 56, 57, 58, 59, directly contact the cover 26 of the controller 14.

FIG. 4 depicts a third embodiment of the assembly according to this invention wherein the top wall 60 of the housing 12 includes a portion which is sloped relatively to the controller 14. Within this sloped portion, the top wall 60 is formed with an elongated opening 62 beneath which is an elongated track 64 proximate the opening 62 and extending along its length. The speed setting means includes a handle having a first portion 66 riding in the track 64 and a second portion 68 extending through the opening 62. There is further provided an extension 70 of the handle and a contact member, illustratively a roller 72, mounted on the extension 70. The roller 72 is adapted to bear against the cover 26 of the controller 14 so as to vary the compression of the controller 14 as the handle moves along the track 64. When the handle is in the OFF position, there is no pressure on the controller cover 26 and the sewing machine 10 is stopped.

FIG. 5 depicts a fourth embodiment of the assembly according to the present invention wherein a speed setting dial 80 is mounted for rotation about a horizontal axis. An eccentric cam 82 is coupled to the dial 80. Mounted for pivotal motion at 84 is a cam follower 86 having a conact member 88 which bears against the top cover 26 of the controller 14. Thus, as the dial 80 is rotated, the eccentric cam 82 changes the pivotal angle of the cam follower 86 and the contact member 88 changes the compression of the controller 14. When the dial 80 is all the way at the SLOW position, all pressure is removed from the controller cover 26 and the sewing machine 10 is stopped.

FIG. 6 depicts a fifth embodiment of the assembly according to the present invention wherein a knob 90 is mounted for rotation about a vertical axis on the top wall 92 of the housing. Mounted beneath the knob 90 is a spiral cam 94. A bar 96 pivoted at 98 has a cam follower 100 mounted at the end opposite the pivot 98, the cam follower 100 being in contact with the spiral cam 94. Rotation of the knob 90 causes the bar 96 to pivot about the point 98. Mounted on the bar 96 is a contact member 102 which bears against the top cover 26 of the controller 14. Thus, as the knob 90 is rotated, varying amounts of compression of the controller 14 are attained. When the knob 90 is all the way at the SLOW position, all pressure is removed from the controller cover 26 and the sewing machine 10 is stopped.

It should be noted that although the embodiments shown and described herein have been depicted as being mounted on either the front or side of the sewing machine, each of the embodiments may be mounted either way.

Accordingly, there has been disclosed an assembly for converting a sewing machine speed controller of the foot operated type to hand operation whereby an operator can set a desired speed and the assembly will maintain its condition. It is understood that the above-described embodiments are merely illustrative of the application of the principles of this invention. Numerous other embodiments may be devised by those skilled in the art without departing from the spirit and scope of this invention, as defined by the appended claims.

I claim:

1. An assembly for converting a sewing machine speed controller of the foot operated type to hand operation thereof, the amount of compression of said controller determining the speed of said sewing machine, said assembly comprising:

a housing for slidably accepting said speed controller therein and adapted to be mounted on the sewing machine, said housing including a front wall, a rear wall, a top wall and a lower support for said controller;

hand operable speed setting means mounted on the top wall of said housing and accessible to an operator for allowing an operator to manipulate said setting means to a specific condition so as to set a desired speed for said sewing machine and for maintaining the set condition; and actuator means coupled to said speed setting means and responsive to a set condition thereof for controlling the compression of said controller.

2. The assembly according to claim 1 further including latch means for releasably securing said speed controller in said housing.

3. The assembly according to claims 1 or 2 wherein said setting means comprises a plurality of push buttons each of which corresponds to a desired speed and each of which when depressed extends into said housing a distance corresponding to its respective desired speed.

4. The assembly according to claim 3 wherein said actuator means comprises a plate mounted for pivotal motion within said housing in a location intermediate said speed controller and said plurality of push buttons so that depression of one of said push buttons by an operator causes pivoting of said plate to compress said speed controller an amount corresponding to the desired speed corresponding to the depressed push button.

5. The assembly according to claims 1 or 2 wherein said housing is formed with an elongated opening in its top wall and said speed setting means includes an elongated track mounted within said housing on said top wall and proximate said opening, and a handle having a first portion riding in said track and a second portion extending through said opening, and wherein said housing top wall includes a portion which is sloped relative said speed controller along the length of said opening and said actuator means includes an extension of said handle inward of said housing and a contact member mounted on said handle extension, said contact member being adapted to bear against said controller so as to control the amount of compression thereof as said handle moves along said track.

6. The assembly according to claim 5 wherein said contact member includes a roller.

7. The assembly according to claims 1 or 2 wherein said speed setting means includes a rotary dial member and said actuator means includes a cam coupled for rotation to said dial member and a cam follower engaging said cam and having mounted thereon a contact member adaped to bear against said controller so as to control the amount of compression of said controller as said dial member is rotated.

* * * * *